United States Patent [19]

Clements

[11] Patent Number: 4,475,625

[45] Date of Patent: Oct. 9, 1984

[54] DETACHABLE NON-CONDUCTIVE PLATFORMS FOR AERIAL BOOM TRUCKS

[76] Inventor: Shannon K. Clements, 6216 Locust Dr., Evansville, Ind. 47712

[21] Appl. No.: 353,090

[22] Filed: Mar. 1, 1982

[51] Int. Cl.[3] ..... E04G 5/08

[52] U.S. Cl. ..... 182/113; 182/2; 182/222

[58] Field of Search ..... 182/222, 223, 113, 2; 256/DIG. 6, 65, 59, 24, 21, 22

[56] References Cited

U.S. PATENT DOCUMENTS

| | | | |
|---|---|---|---|
| 3,072,215 | 1/1963 | Rush | 182/2 |
| 3,385,398 | 5/1968 | Garnett | 182/46 |
| 3,747,706 | 7/1973 | Paine | 182/113 |
| 4,140,230 | 2/1979 | Pearson | 182/223 |
| 4,323,140 | 4/1982 | Foscarini | 182/222 |
| 4,371,056 | 2/1983 | Anglade | 182/113 |

*Primary Examiner*—Reinaldo P. Machado
*Assistant Examiner*—Alvin Chin-Shue
*Attorney, Agent, or Firm*—Eugene C. Knoblock

[57] ABSTRACT

A platform for attachment to an aerial boom, said platform being constructed of lightweight dielectric material and mounting collapsible guard rails. The platform includes braces which stabilize and position it on the aerial boom.

2 Claims, 11 Drawing Figures

DETACHABLE NON-CONDUCTIVE PLATFORMS FOR AERIAL BOOM TRUCKS

SUMMARY OF THE INVENTION

This invention relates to a platform for use in connection with an aerial boom.

The platform includes a walkway having braces extending from its lower surface. The braces stabilize the walkway upon an aerial boom or other support which has a narrower cross-section than the walkway. Collapsible guard rails are positioned on the lateral edges of the walkway. The guard rail supports may be locked in an operative position perpendicular to the walkway when the walkway is in working position, or may be collapsed on the walkway. The walkway, braces and guard rail of the platform are made of a material that is dielectric, weatherproof and lightweight for easy mounting and removal from the boom.

Accordingly, it is an object of this invention to provide a platform which can be attached to an aerial boom to support several persons in an aerial work position.

Another object of this invention is to provide a platform which is constructed of dielectric material to permit several persons to work upon electric power lines and components without de-energizing the electric line.

It is another object of this invention to provide a platform which is lightweight, strong, and is easily and quickly affixed to and removed from an aerial boom.

Other objects of this invention will become apparent upon a reading of the following description.

DESCRIPTION OF THE PREFERRED EMBODIMENT

Figure 1:
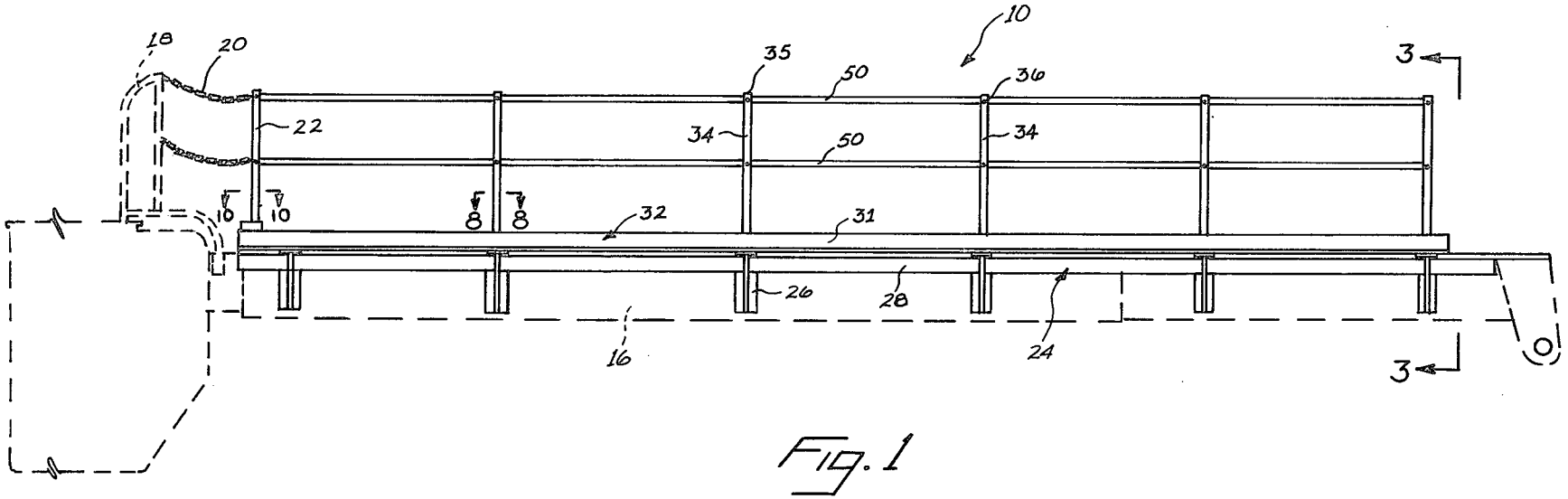
FIG. 1 is a side view of the platform in its work position on a part of an aerial boom drawn in broken lines.

The preferred embodiment is not intended to be exhaustive or to limit the invention to the precise form disclosed. It is chosen and described in order to explain the principles of the invention and its application and practical use to thereby enable others skilled in the art to utilize the invention.

The platform 10 of this invention is intended for use in connection with an aerial boom vehicle 12 having a bucket 14 attached at one end of a boom 16. Boom 16 is preferably horizontal in its various adjustments. An operator of aerial boom vehicle 12 may move from bucket 14 to platform 10 via a ladder 18. Chains 20 extend between ladder 18 and an upright 22 at the end of platform 10.

Figure 3:
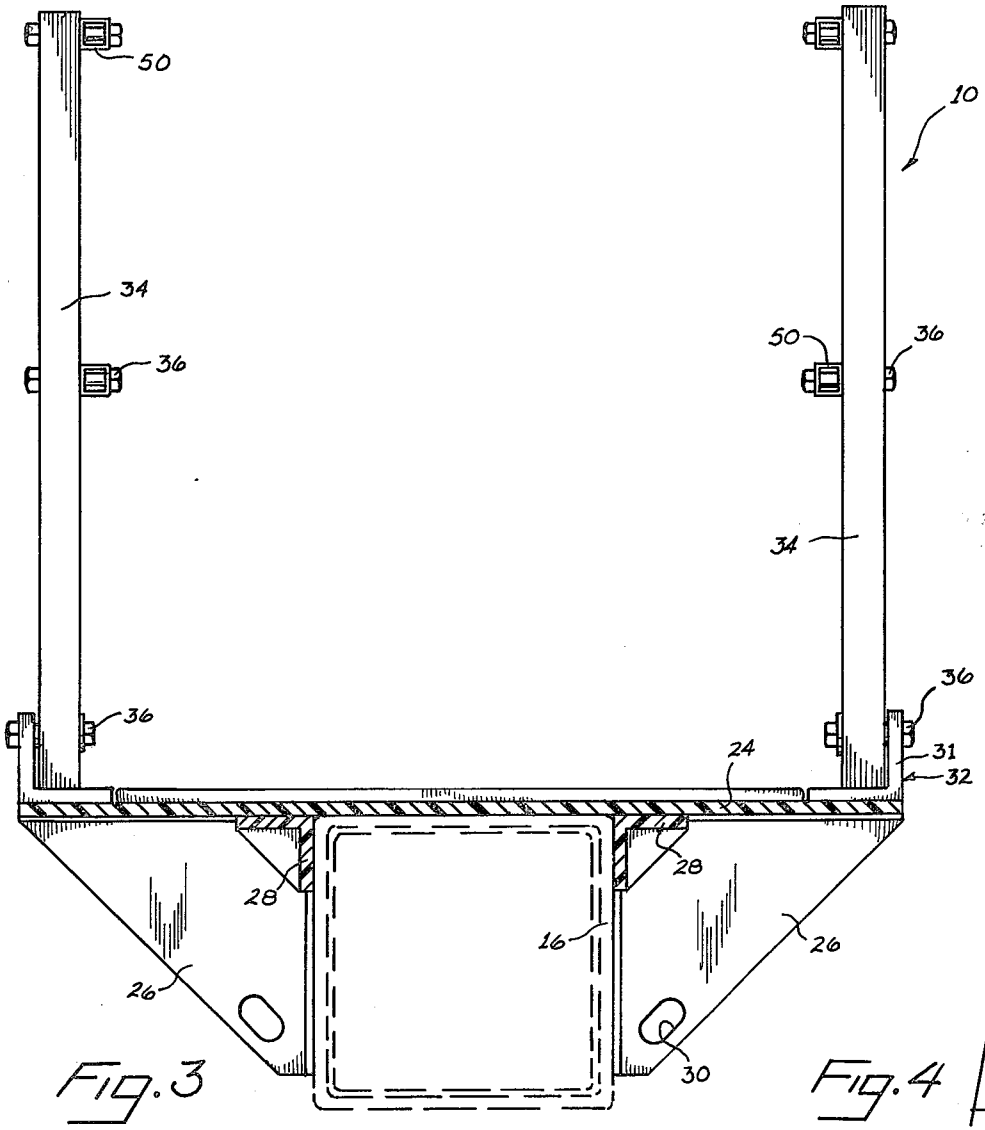
FIG. 3 is a sectional view taken along line 3—3 of FIG. 1.

Platform 10 includes a walkway 24 having transverse gussets 26 or braces which project from the lower surface of walkway 24. Gussets 26 are spaced apart and are arranged in pairs between which the boom 16 is positioned as shown in FIG. 3 when the walkway is carried by the boom. Longitudinal braces 28 are secured to the bottom surface of walkway 24 and are spaced apart to engage the sides of boom 16 and to provide support for the walkway and the gussets 26. Gussets 26 have openings 30 at their lower portions through which may be passed a rope (not shown), or other fastening device, for anchoring walkway 24 to the boom 16. Gussets 26, braces 28 and walkway 24 are preferably formed of fiberglass material for a high strength-to-weight ratio and for the dielectric properties of fiberglass. A non-skid pad may cover walkway 24 to sure footing for a person standing on the walkway.

Figure 2:
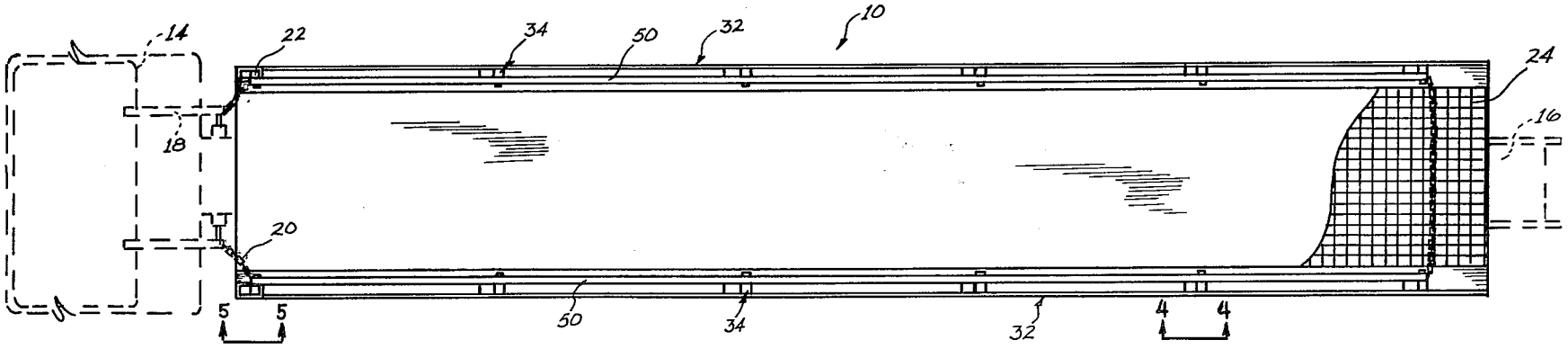
FIG. 2 is a top view of the platform.
Figure 4:
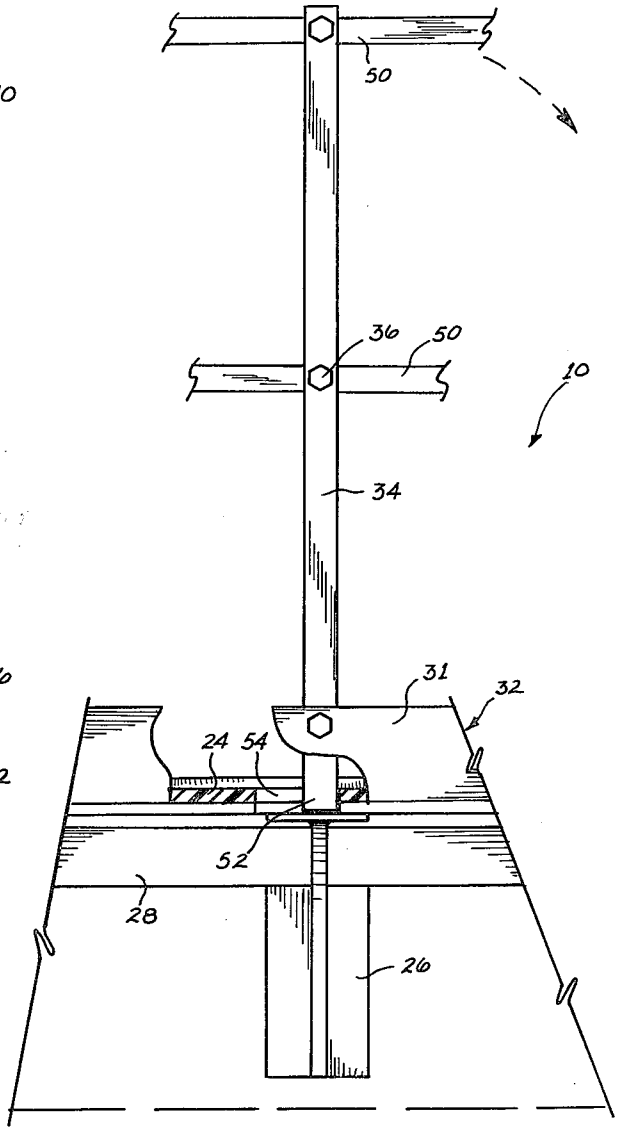
FIG. 4 is a partial side view taken in the direction of lines 4—4 of FIG. 2 and having portions broken away.
Figure 7:
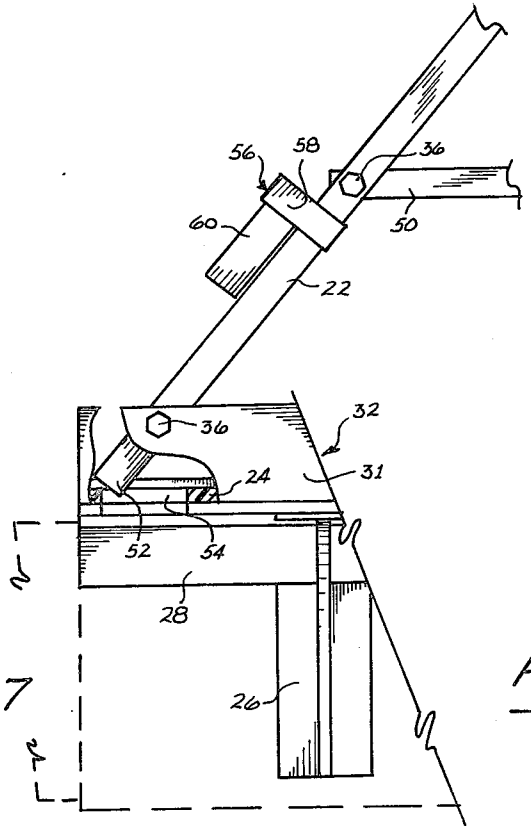
FIG. 7 is a partial side view of the end upright of FIG. 5 illustrating the folding of the upright and railing into its storage position.
Figure 9:
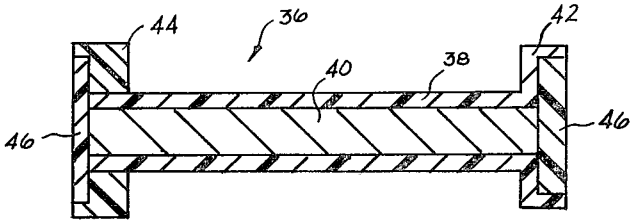
FIG. 9 is a sectional view of a bolt used to fasten parts of the platform together.

An angled longitudinal rail 32 is secured along each lateral edge of walkway 24 at spaced intervals and extends upwardly at the edge of the walkway. An arm 34 is pivotally connected at its lower end to the upturned portion 31 of rail 32 by bolts 36 or other fastening means. A sectional view of a bolt 36 is shown in FIG. 9 and has a tubular casing 38 and a fiber core 40. Each bolt 36 has a head 42 and a nut 44 is fastened to casing 38 as by an epoxy-resin cap 46. Each arm 34, except for end arm 22, is positioned adjacent to a gusset 26 for strength and support. Longitudinal rails 50 are pivoted to the arms 34 at one side of the walkway at their free ends 35 and at a point intermediate their length by bolts 36. Arms 34 and rails 50 are preferably square hollow fiberglass tubes and are pivotally connected so that the arms and rails may be shifted between an operative position shown in FIG. 2, and a collapsed position as shown in FIG. 7.

Figure 5:
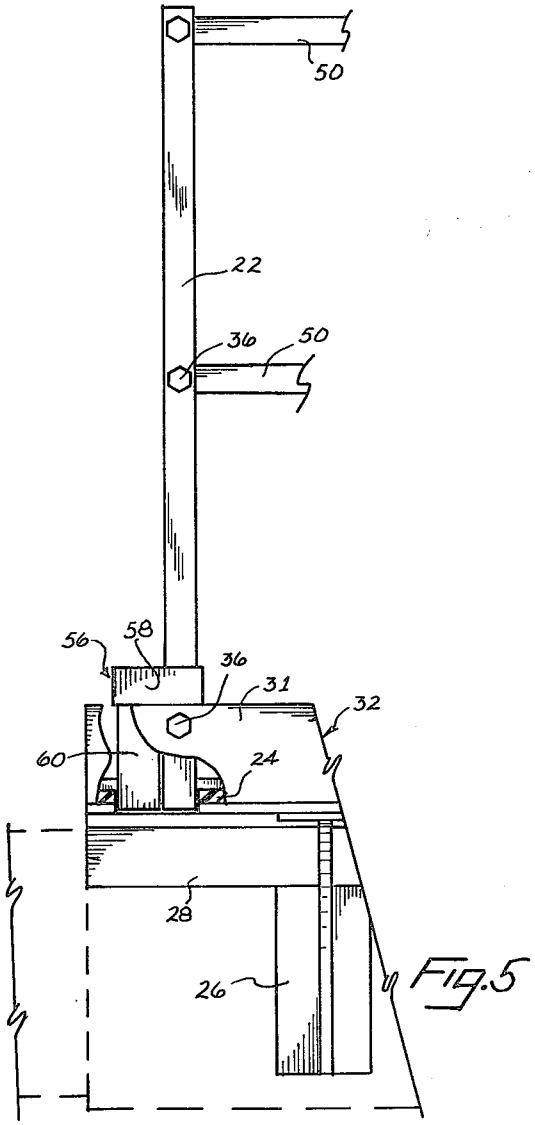
FIG. 5 is a partial side view showing an end upright locked in its working position.
Figure 6:
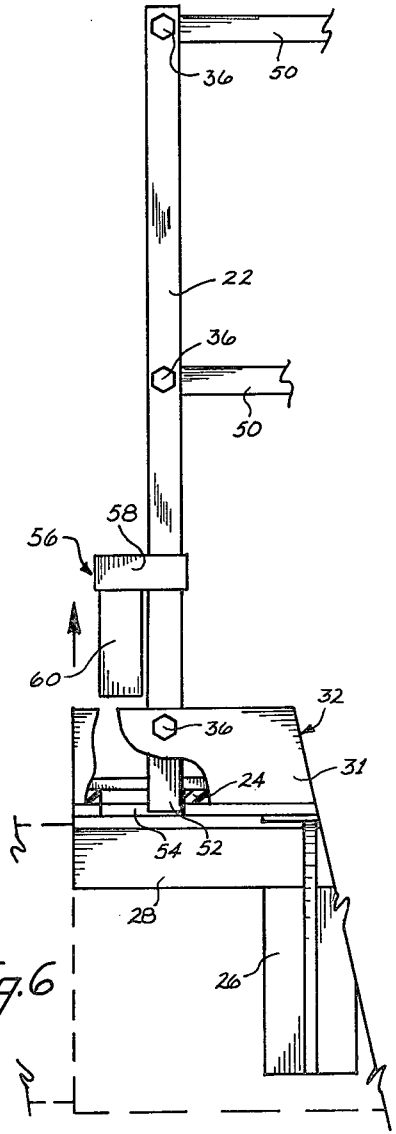
FIG. 6 is a partial side view of the end upright of FIG. 5 illustrating removal of the lock from the strike.
Figure 10:
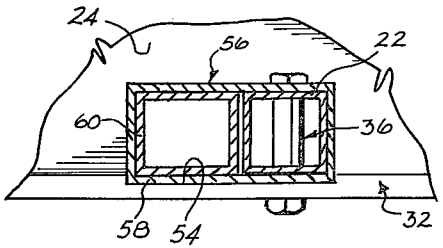
FIG. 10 is a sectional view taken along lines 10—10 of FIG. 1.
Figure 8:
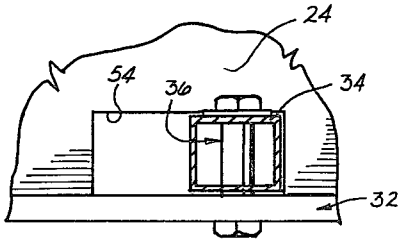
FIG. 8 is a sectional view taken along lines 8—8 of FIG. 1.
Figure 11:
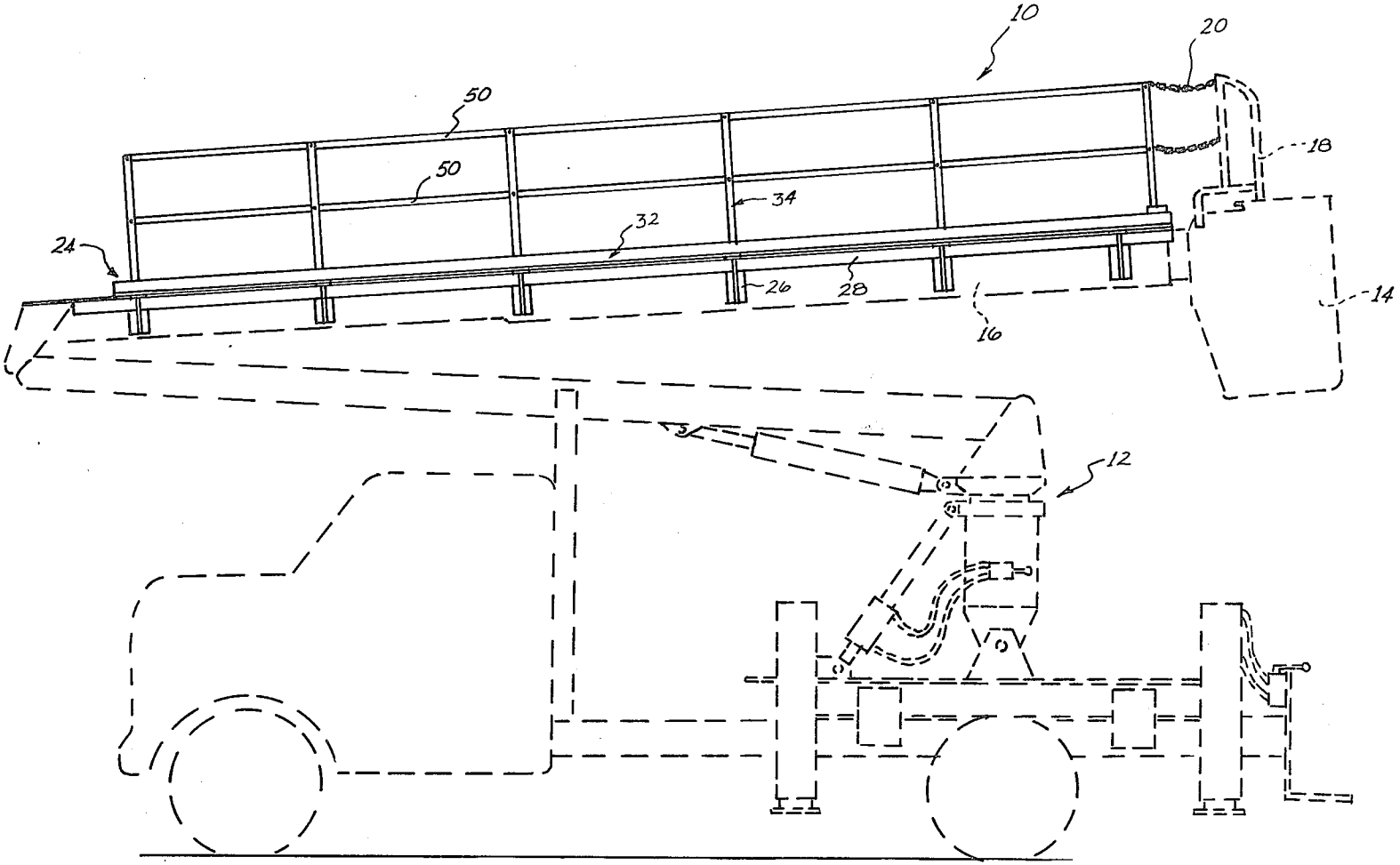
FIG. 11 is a side view of the platform as attached in its working position to an aerial boom shown in broken lines.

The lower end 52 of each arm 34 fits into a socket 54 of the walkway when in operative or extended position. Each socket 54 is positioned adjacent and below a bolt 36 connecting an arm 34 to rail 32. Lower arm ends 52 fit within sockets 54 as shown in FIGS. 8 and 10. End arms 22 include a lock 56, as shown in FIGS. 5-8. Lock 56 includes a sleeve 58 which encompasses end arm 22 in a sliding fit and carries a bolt 60. When each end arm 22 is in its operative position, lock 56 may be lowered to position bolt 60 within socket 54 in a snug fit from side to side and in a similar snug fit between the lower end 52 of the adjacent arm and the end of the socket, as best shown in FIGS. 5 and 10. As shown in FIGS. 6 and 7 lock 56 has been shifted from socket 54 when arms 34 and rails 50 are to be lowered to their collapsed or storage position. The platform construction is readily mounted upon and removed from a boom. It is of lightweight and of adequate strength to support several workers and enable them to move thereon to different locations within an aerial zone at which work is to be done. Also, it is formed of dielectric material which insures safety of workmen who work upon electrically charged elevated objects.

It is to be understood that the invention is not to be limited by the terms of the above description but may be modified within the scope of the appended claims.

What I claim is:

1. In combination, a platform and an aerial boom having a substantially flat platform-supporting surface, said platform including a walkway resting upon the flat surface of said boom, spaced arms each pivotally connected at one end to a marginal portion of said walkway, a rail pivotally connected to each arm on one side of said walkway, and a plurality of longitudinally spaced pairs of transversely spaced gussets projecting downwardly from said walkway, said gussets being positioned at opposite sides of said boom when said platform is supported on said boom, means shiftable on an arm releasably anchoring said arm in substantially perpendicular relation to and above said walkway, said walkway including a marginal upturned flange, each of said arms being pivotally connected adjacent one end thereof to an upturned flange spaced above said walkway, said anchoring means including a socket formed in said walkway, said anchor and one end of said arm being adapted to project into said socket with a snug fit to anchor the arm in substantial perpendicular relation to and above said walkway.

2. The combination of claim 1 wherein said anchor means includes a sleeve which is slidable on said one arm, and a bolt projecting from said sleeve and releasably fitting in said socket in a snug fit along side said arm.

* * * * *